US010465514B2

(12) United States Patent
Baiden

(10) Patent No.: US 10,465,514 B2
(45) Date of Patent: Nov. 5, 2019

(54) TELEROBOTIC SHRINKAGE MINING

(71) Applicant: Penguin Automated Systems Inc., Naughton (CA)

(72) Inventor: Gregory Baiden, Lively (CA)

(73) Assignee: Penguin Automated Systems Inc., Naughton (CA)

( * ) Notice: Subject to any disclaimer, the term of this patent is extended or adjusted under 35 U.S.C. 154(b) by 0 days.

(21) Appl. No.: 15/726,825

(22) Filed: Oct. 6, 2017

(65) Prior Publication Data

US 2018/0100394 A1 Apr. 12, 2018

Related U.S. Application Data

(60) Provisional application No. 62/404,812, filed on Oct. 6, 2016.

(51) Int. Cl.

| | |
|---|---|
| ***E21C 41/22*** | (2006.01) |
| ***F42D 1/22*** | (2006.01) |
| ***F42D 3/04*** | (2006.01) |
| ***F41H 7/00*** | (2006.01) |
| *F41H 7/10* | (2006.01) |
| *F41H 11/16* | (2011.01) |
| *F41H 11/28* | (2011.01) |
| *F41H 11/32* | (2011.01) |

(52) U.S. Cl.

CPC ..... *E21C 41/22* (2013.01); *F41H 7/005* (2013.01); *F42D 1/22* (2013.01); *F42D 3/04* (2013.01); *F41H 7/10* (2013.01); *F41H 11/16* (2013.01); *F41H 11/28* (2013.01); *F41H 11/32* (2013.01)

(58) Field of Classification Search

CPC ..... E21B 44/00; E21B 7/022; E21C 41/22; F42D 3/04; F42D 1/08; F42D 1/22; F41H 11/16; F41H 11/28; F41H 11/32; F41H 7/005; F41H 7/10

See application file for complete search history.

(56) References Cited

U.S. PATENT DOCUMENTS

2010/0270076 A1* 10/2010 Ahola ..... E21B 7/025 175/2
2016/0084071 A1* 3/2016 Muona ..... E21D 9/006 175/24
2017/0314331 A1* 11/2017 McCracken ..... E21B 7/025

* cited by examiner

*Primary Examiner* — Carib A Oquendo
(74) *Attorney, Agent, or Firm* — DLA Piper LLP (US)

(57) ABSTRACT

Provided is a telerobotic mining device for underground mining, and specifically for stope mining, as well as a method of mining using such a device. The telerobitic mining device is capable of remotely moving about a mine and utilizing drill arms to drill a hole within a chosen rock bed. Explosive placement arms on the telerobot may be utilized to place an explosive within the drilled hole to blast away rock. Control over the device is achieved by way of operational commands that may be wirelessly sent to the device from a command center located outside the mine.

12 Claims, 3 Drawing Sheets

Cover Plate
Tube
Tube
Tube

TELEROBOTIC SHRINKAGE MINING

TECHNICAL FIELD

The present disclosure relates to telerobotic mining devices and systems, particularly for shrinkage stoping.

DESCRIPTION OF THE RELATED ART

Shrinkage stoping is a method of underground mining in which ore is excavated from the mine in horizontal slices. The process proceeds from the bottom of the excavation and advances upwards, up the excavation. The excavation space is also known as a stope.

Explosives or drills are used in the process to separate ore from its place in situ. Through blasting or drilling, the volume that the rock occupies increases by some 50% from its original volume in the rock bed. Drilling and blasting is carried out by miners as overhead stoping, and the separated rock is left to fall and fill the mined-out stope.

Ore that is broken in the process is initially left in place, where it has fallen, within the mined-out stope. In such a manner, the blasted ore provides both a working platform from which miners can mine remaining ore above the stope and support to the stope walls. Due to the volume increase of blasted or drilled ore, some 40% of the ore must be drawn off continuously during the mining process. Drawing off of the ore maintains room for the miners atop the stope and allows for mining to continue. Ore may be drawn-off through drawpoints, in the form of chutes, and may be drawn directly into rail cars. The rail cars are generally gravity-fed.

Conventional shrinkage stoping, as has been employed in the past, suffers from a number of drawbacks, which limit its overall effectiveness: It is labour-intensive, working conditions are difficult and dangerous, and the overall process is inefficient. The efficiency of the conventional process is only about 3 to 9 t (3.3 to 9.9 st) per worker-shift. Further, only 35% to 40% of the ore is actually made available for extraction during a mining cycle.

The current application describes a telerobotic system and method for shrinkage mining in which the drawbacks of the conventional process are mitigated.

BRIEF DESCRIPTION OF THE DRAWINGS

In drawings that illustrate by way of example only embodiments of the present disclosure, in which like reference numerals describe similar terms throughout the various figures.

DETAILED DESCRIPTION

The present disclosure provides a telerobot and telerobotic system that is capable of carrying out the shrinkage mining process.

Figure 1:
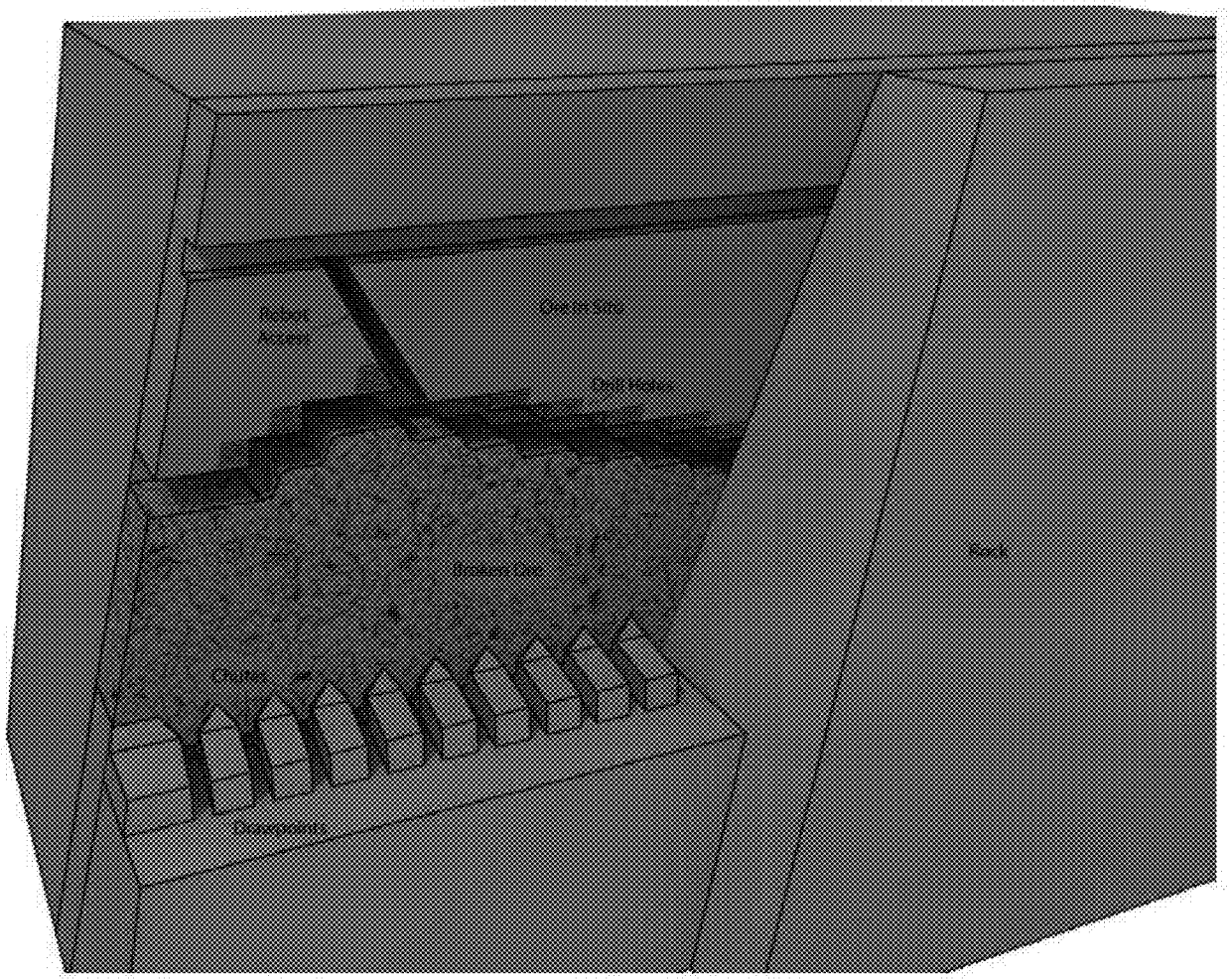
FIG. 1 is an exemplary schematic of a stope mine

As can be seen in FIG. 1, in stope mining, tunnels may be formed in a rock bed, both above and below what may typically be a thin and somewhat vertical ore vein. Drawpoints, in the form of chutes, may be cut above the lower tunnel, and may be used to draw ore that has been separated from its place in situ down the stope. An off-vertical opening may also be drilled above the upper tunnel. A telerobot may be lowered down the off-vertical opening. The telerobot may be connected by winch, or by any other suitable manner, to a transport truck. The transport truck may also contain the command centre required for teleoperation of the telerobot. Alternatively, the command centre may be located at a location that is further remote from the mine. The transport truck may hold mining supplies to resupply the telerobot as needed; these supplies may also be housed off-site and may be transported in as needed. If the telerebot breaks down in the mine, the area may be secured for personnel entry to correct the problem and return the telerobot to operation.

Figure 2:
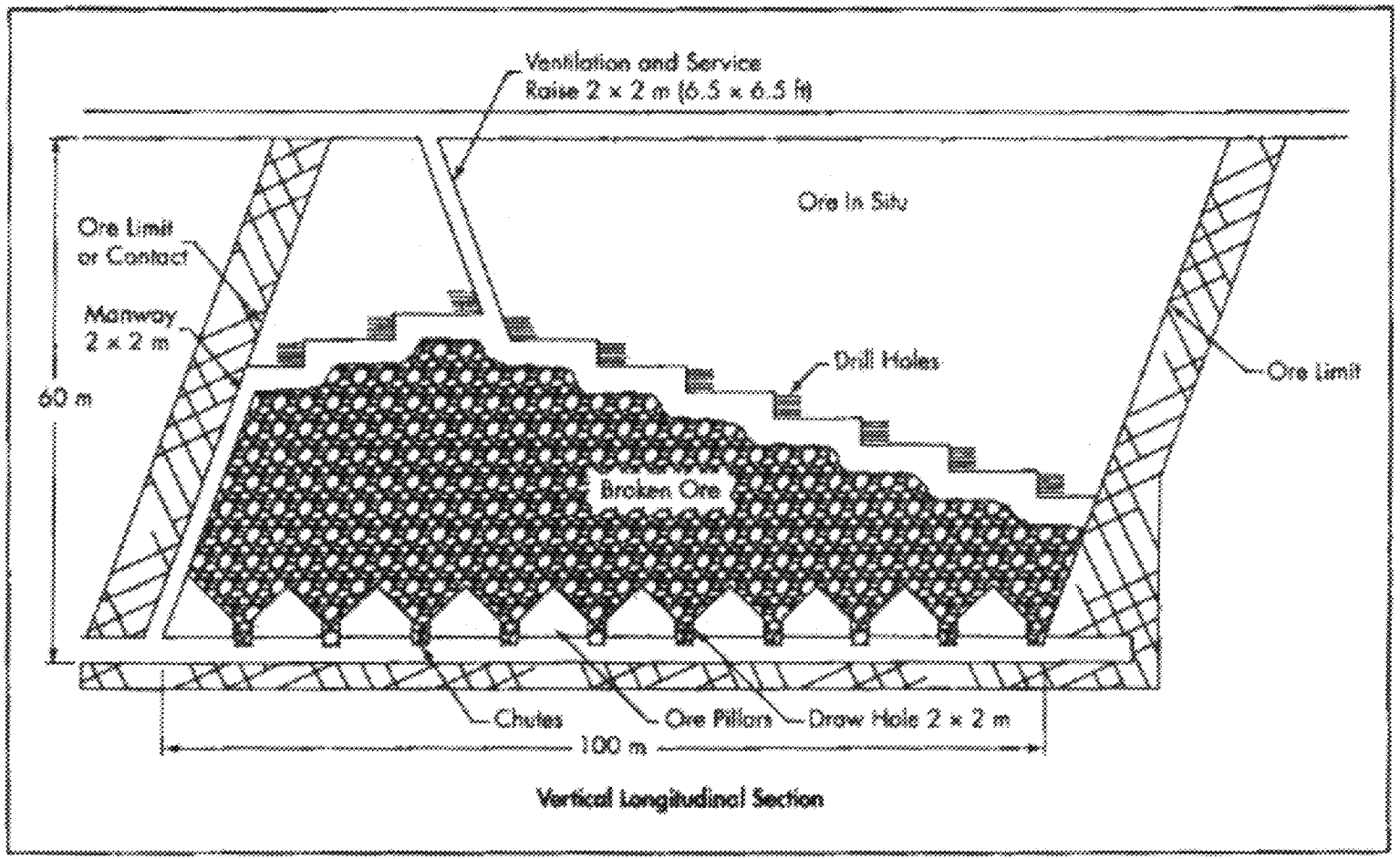
FIG. 2 is a further exemplary schematic of a stope mine.

As can be further seen in FIG. 2, the off-vertical opening may serve as a service shaft, as well as a ventilation shaft. In either case, the size of the shaft is sufficient to allow a telerobot to descend into the mine. As can further be seen in FIG. 2, the depth of a stope may be on the order of 60 meters, while the overall longitudinal length of the excavation may be on the order of 100 meters. A manway may also be cut, in a cross-sectional area of 2×2 meters, down one side of the stope. In conventional stope mining, the manway may provide sufficient space to facilitate the movement of miners as between the top and bottom of the stope.

In conventional stope mining, miners atop the stope are required to drill above the stope, or otherwise blast the ore from its place in the rock bed, typically with dynamite or other explosives. Given the confined nature of the mining space, the use of drills and explosives creates a hazardous working environment for the miners. Furthermore, the ore that is blasted or otherwise removed from the rock bed is meant to provide a working platform for the miners. At the same time, the ore is to be continuously drawn out from the bottom of the stope by way of the drawpoints. Therefore, not only is the miner required to use dangerous equipment in a confined space to loosen ore, the platform from which they are to work is inherently unstable. As such, a safer method of mining can be achieved if the requirement to have a human miner work atop the stope with dangerous equipment is rendered unnecessary.

Figure 3:
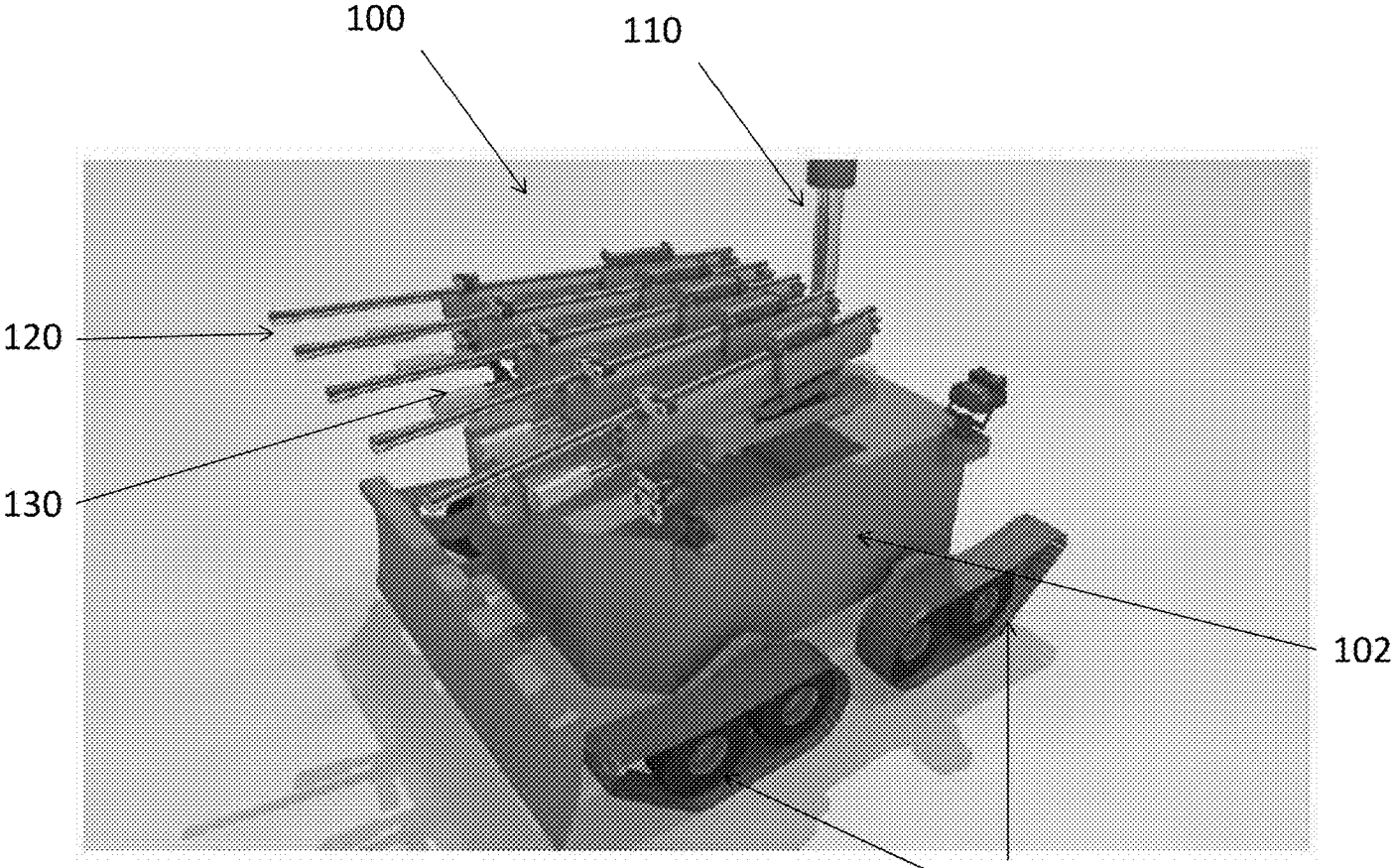
FIG. 3 is a schematic of an exemplary embodiment of a telerobot capable of carrying out the steps required for shrinkage mining.

FIG. 3 provides a schematic of an exemplary telerobot that is capable of carrying out specific steps in the mining process in order to mitigate the need for human involvement in the process.

The overall performance of the mining method using a telerobot may be based on several principles, which are in turn based on setting up infrastructure to use the telerobot shown in in FIG. 3. The telerobot may be a vehicle capable of two major functions. The first is assessing and setting up the machine for work and the second is the performance of work. The telerobot may have a series of devices to measure location, such as an x,y,z, pitch, roll, yaw through devices such as an IMU, LIDAR, mineral assessment sensors, cameras and other sensors or equipment. Using the information transmitted by way of signals over a network, the telerobot can be teleoperated inside the mineral body where it is dangerous for personnel to work. The telerobot may even operate in locations where personnel cannot work at all. The network over which signals are transmitted may be a wired or wireless network, and may function at any suitable frequency. A teleoperator may be provided with the situational awareness to drill, load and ignite explosives or to implement some other method of rock fragmentation.

For details on communication with the telerobot disclosed herein, the following are hereby incorporated by reference: U.S. Pat. No. 8,310,238 B2, U.S. application Ser. No. 13/882,131, PCT Publication No. WO 2015/127545, and U.S. Provisional Patent Application No. 62/370,103.

As can be seen in FIG. 3, in one embodiment, the telerobot 100 comprises a body 102, with a set of wheels 103. The wheels 103 may be on a track, which may in turn provide good maneuverability for the telerobot over an uneven rock surface, such as that which is created by the separated ore that has fallen into the stope. The track may allow the robot to move over the uneven rock surface at a pace that is much faster than a human is capable of achieving. This increase in speed may allow for more ore to be extracted within a given time frame.

The telerobot may contain a communications module 110, which allows it to receive operational commands from a remote command centre. The communications module 110 may also be operative to send signals out to the command centre, such as status signals, relating to the operational status of the telerobot. For example, a telerobot may send out a signal indicating that an error has occurred or that it has broken down in some manner. This signal may provide information to the command centre indicating that personnel should enter the mine to correct the problem and return the telerobot to operation. Alternatively, a further telerobot or telerobots may be sent into the mine to remedy the issue.

The telerobot may further comprise one or more drill arms 120. Control over the drill arms 120 may be accomplished by way commands sent by the teleoperator from the command centre, which are received by the communications module 110. Sensors may be used to provide the module with information, which is transmitted back to the command centre and which relates to the current position of the drill arms 120, as well as the rock wall. The teleoperator, or a computer system, may analyze this information to assess where and at what depth drilling should take place.

The telerobot may further comprise one or more explosive placement arms 130. These arms allow the telerobot to insert an explosive into a hole that has been drilled in the rock bed, once a command to do so is received or analyzed. The drill arms 120 and the explosive placement arms 130 may be the same arms, or multiple use-specific arms may be employed. The command to insert the explosive may be issued by a teleoperator from a command centre; alternatively, the instructions may be preprogrammed into a memory within the telerobot, and may be carried out by a microcontroller or other device. The telerobot 100 may further have a process to ignite the placed explosives. Alternatively, the explosives may be timed to go off at after a sufficient delay, which allows the telerobot to move away.

Telerobotic operation increases the overall efficiency of stope mining as it increases the amount of ore that is available for extraction during a typical mining cycle. Further, without the need to have human operators in the mine itself, the overall costs of the method are decreased.

Throughout the specification, terms such as "may" and "can" are used interchangeably. Use of any particular term should not be construed as limiting the scope or requiring experimentation to implement the claimed subject matter or embodiments described herein. Further, while this disclosure may have articulated specific technical problems that are addressed by the disclosure(s), the disclosure is not intended to be limiting in this regard; the person of ordinary skill in the art will readily recognize other technical problems addressed by the disclosure(s).

A portion of the disclosure of this patent document contains material which is or may be subject to one or more of copyright, design, or trade dress protection, whether registered or unregistered. The rightsholder has no objection to the reproduction of any such material as portrayed herein through facsimile reproduction of this disclosure as it appears in the Patent and Trademark Office records, but otherwise reserves all rights whatsoever.

It is claimed:

1. A method for shrinkage stoping of an ore body comprising, lowering a telerobot onto a loose ore platform within a stope, the loose ore being drawn from the stope from below through at least one drawpoint, operating the telerobot on the loose ore platform using a combination of (a) teleoperation by operational commands received over a wireless network from a command centre, and (b) autonomous operation by execution of operational commands stored in a programmable memory of a microcontroller on the telerobot based on predetermined input information, moving the telerobot through teleoperation to a position proximate to a rock wall to be blasted, sensing the configuration of the rock wall surface using at least one onboard sensor and transmitting the sensed information over the wireless network to the command centre, extending a plurality of drill arms from the telerobot through autonomous operation to drill corresponding holes into the rock wall at locations predetermined by a teleoperator based on the sensed information, and placing at least one explosive into each hole through autonomous operation, moving the telerobot to a safe location away from the rock wall through teleoperation before igniting the explosives.

2. The method of claim 1, wherein each of the plurality of drill arms is extended consecutively.

3. The method of claim 1, wherein at least two of the plurality of drill arms is extended simultaneously.

4. The method of claim 1, wherein the at least one explosive is placed into each hole by extending a plurality of explosive placement arms from the telerobot through autonomous operation.

5. The method of claim 4, wherein each of the plurality of explosive placement arms is extended consecutively.

6. The method of claim 5, wherein at least two of the plurality of explosive placement arms is extended simultaneously.

7. The use of a telerobot for shrinkage stoping of an ore body comprising, lowering the telerobot onto a loose ore platform within a stope, the loose ore being drawn from the stope from below through at least one drawpoint, operating the telerobot on the loose ore platform using a combination of (a) teleoperation by operational commands received over a wireless network from a command centre, and (b) autonomous operation by execution of operational commands stored in a programmable memory of a microcontroller on the telerobot based on predetermined input information, moving the telerobot through teleoperation to a position proximate to a rock wall to be blasted, sensing the configuration of the rock wall surface using at least one onboard sensor and transmitting the sensed information over the wireless network to the command centre, extending a plurality of drill arms from the telerobot through autonomous operation to drill corresponding holes into the rock wall at locations predetermined by a tele operator based on the sensed information, and placing at least one explosive into each hole through autonomous operation, moving the telerobot to a safe location away from the rock wall through teleoperation before igniting the explosives.

8. The use of claim 7, wherein each of the plurality of drill arms is extended consecutively.

9. The use of claim 7, wherein at least two of the plurality of drill arms is extended simultaneously.

10. The use of claim 7, wherein the at least one explosive is placed into each hole by extending a plurality of explosive placement arms from the telerobot through autonomous operation.

11. The use of claim 10, wherein each of the plurality of explosive placement arms is extended consecutively.

12. The use of claim 10, wherein at least two of the plurality of explosive placement arms is extended simultaneously.

* * * * *